US005101653A

United States Patent [19]

Hermes et al.

[11] Patent Number: 5,101,653

[45] Date of Patent: Apr. 7, 1992

[54] MECHANICAL PIPE EXPANDER

[75] Inventors: Rolf Hermes, Mönchengladbach; Herbert Jansen, Korschenbroich; Hans G. Schiffers; Arno Topüth, both of Mönchengladbach, all of Fed. Rep. of Germany

[73] Assignee: Mannesmann Aktiengesellschaft, Dusseldorf, Fed. Rep. of Germany

[21] Appl. No.: 617,901

[22] Filed: Nov. 26, 1990

[30] Foreign Application Priority Data

Nov. 24, 1989 [DE] Fed. Rep. of Germany ..... 3939356

[51] Int. Cl.[5] ..... B21D 41/02

[52] U.S. Cl. ..... 72/393

[58] Field of Search ..... 72/393

[56] References Cited

U.S. PATENT DOCUMENTS 3,798,955 3/1974 Wimmer et al. ..... 72/393

FOREIGN PATENT DOCUMENTS 66001 8/1975 Australia ..... 72/393

*Primary Examiner*—Lowell A. Larson

*Attorney, Agent, or Firm*—Cohen, Pontani & Lieberman

[57] ABSTRACT

A mechanical pipe expander having a pyramidal, polyhedronal cross-section, segments resting against the pyramidal surfaces which are displaceable in axial direction relative to the polyhedron, and grooves formed in the longitudinal centers of the edges of the polyhedron so that the side surfaces of the grooves represent guides for the correspondingly shaped segments. The segments are formed as dove tails on the leading end thereof over a length of about 5-30% of their total length and each of the side surfaces of the dove tail recesses slide on a side surface of two adjacent grooves formed in the polyhedron. The length of the grooves is limited to the path of displacement of the polyhedron with respect to the segments, and the ends of the segments facing away from the leading end are held by radially acting springs against the surfaces of the polyhedron.

6 Claims, 2 Drawing Sheets

15
5
4
2
1
3
6

4
7
2
1

MECHANICAL PIPE EXPANDER

FIELD OF THE INVENTION

The present invention relates to a mechanical pipe expander and more particularly to an expander having a pyramidal, polyhedronally-shaped member with a series of grooves located at the center of the longitudinal edges of the polyhedron and forming tenons therebetween, and a number of displaceable segments which rest against the pyramidal surface of the polyhedronal member and are each provided with mortises which form dove-tailed connections with the tenons.

BACKGROUND OF THE INVENTION

A mechanical pipe extender having multiple segments is shown in German Patent No. 2,611,702. In this prior art device, the segments are guided and attached by means of bronze ledges that are shaped like a "T" in cross-section, and conform with conically tapered ring grooves in a polyhedronally-shaped member.

This prior art pipe expander, however, has proven only partially satisfactory. One problem exists in the high expense associated with the production of the continuous, conical grooves. Other problems exist with the basic structure. For example, the construction causes weakening of the polyhedronally-preshaped member particularly on its thin end, and reduction in its available surface area for the resting or attachment of the displaceable segments. In accordance with the design of this prior art device, the displaceable segments possess protruding T-shaped edge portions for insertion into the corresponding recesses in the polyhedronally-shaped member, which frequently break when placed under high loads. Likewise, there is a danger that upon idle travel the segments will tilt between two work strokes, as a consequence of the influence of gravity, and cause the formation of a non-uniform or incomplete lubricating film. Also, particles of dirt can find their way into the gap produced by the tilting of the segments, and enter between the sliding surfaces, leading, when under load, to severe damage and inability to properly move the sliding surfaces and segments.

It is thus an object of the present invention to overcome the disadvantages possessed by the prior art device by the provision of a multi-segment mechanical pipe expander with a different conformation and shape for the slidable cooperation between the segments. It is a further object to provide an optimally large resting surface between the segments to allow for the handling of great loads while at the same time assuring dependable guidance, alignment and attachment.

SUMMARY OF THE INVENTION

The foregoing and other objects of the instant invention are achieved by the provision of a tapered member having a polyhedronal cross-section, pyramidally shaped walls, and a plurality of tenons placed between the junctions of each of the walls, against which a plurality of segments are placed. Each of said segments has a leading and following end, and a mortise of predetermined length commencing at the leading end. Each mortise and tenon form a dove-tailed connection that is slidable in an axial direction relative to the polyhedronal cross-section.

In a preferred embodiment, the length of each mortise starting at the inner side of the leading end of each segment is about 5% to 30% of the total length of the segment and each of the side surfaces of the dove tail mortise slides on a respective side surface of the tenon which are separated and formed by longitudinal grooves at the junction of two adjoining walls of the polyhedron. The length of the grooves correspond to the path of displacement of the segments with respect to the tapered member. In a further preferred embodiment, spring means are provided on the following end of each of the segments for urging the following ends in a radially inward direction.

It is also a feature of the instant invention to provide a pipe expander wherein the thin portion of the tapered member (which is under the greatest stress) is not weakened by having grooves placed in it, but rather the grooves formed by the ends of each of the tenons are placed in the thicker portion of the tapered member. Thus, the dove-tailed guidance mechanism is shifted in a downward direction from the area of greatest load, to the thicker region of the tapered member. Moreover, since the dove-tailed grooves are shallow in the tapered member, this member is weakened less than that of the prior art, which has larger T-shaped grooves. Also the grooves in the instant invention are not conical, and thus are substantially simpler in production than those of the prior art.

As a consequence of the configuration herein, the mortise portion of each of the segments, in cross-section, defines a trapezoid, and the trapezoidal mortise resting surfaces sit against the conforming trapezoidal tenon surfaces, increasing the surface-to-surface contact between tapered member and segments by approximately 25% over the prior art. As a result of this increased surface area of contact, the pressure per unit of surface is reduced in the instant invention over that of the prior art, and it therefore becomes possible to use the same surface pressure as before to now expand thicker-walled pipes. Expanding such pipes has long been a desired goal of large pipe mills, and can now be achieved.

It is yet another feature of the instant invention, as a consequence of its special configuration, that the surface to surface lubrication is eased, since smooth, continuous slide surfaces are formed. Thus, the number of lubricating holes and conduits are reduced in the instant invention.

In a preferred embodiment of the instant invention, the mortises are placed in bronze shoes and the bronze shoes are fastened to the segments. Additionally, feather keys can be inserted between the segments and bronze shoes in order to take up lateral forces.

It is yet a further feature of the instant invention to provide a plurality of leaf springs that create a radially inwardly directed urging against the following ends of each of the segments, thus urging the segments to remain in continuous contact with the tapered member, so that there is little, if any penetration of particles of dirt between the sliding surfaces. The spring means can be comprised of trapezoidal leaf springs the narrow ends of which press against the segments.

BRIEF DESCRIPTION OF THE DRAWINGS

Other objects and many of the attendant advantages and features of the instant invention will be readily appreciated and better understood by reference to the following detailed description in connection with the accompanying drawings in which like referenced numerals designate like parts, and wherein.

DETAILED DESCRIPTION OF THE PREFERRED EMBODIMENTS

Figure 1:
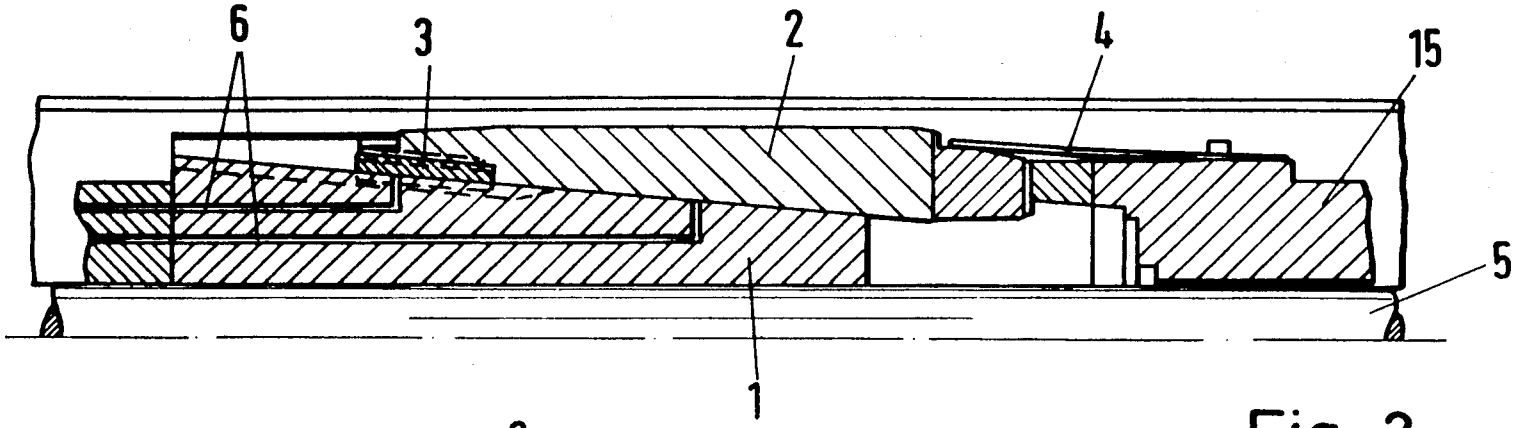
FIG. 1 is a longitudinal section through a pipe expander in accordance with the instance invention.

In FIG. 1, tapered member 1 is shown in cross-section with one of its pyramidal side walls 20. It is to be understood that tapered member 1 has a polyhedronal cross-section, having on its exterior a series of pyramidal walls, each with a pyramidal facial structure, that abut with and contact each of a plurality of segments 2, the number of segments conforming with the number of polyhedronal surfaces or walls possessed by tapered member 1. One of segments 2 is shown in a wedge-shaped formation in FIG. 1, with a thinner or leading end 24, a thicker or following end 26 and a segment wall 22. As shown in FIG. 1, a pyramidal wall 20 of tapered member 1 lies against segment wall 22. Towards the thinner end 24 of segment 2 in FIG. 1, guide 3 is shown, in this, the preferred embodiment, as a bronze shoe. Under an alternative embodiment, guide 3 may be part and parcel of thinner end 24 of segment 2, without being a separate element. Also as shown in FIG. 1, guide 3 is positioned towards the thicker portion of tapered member 1.

The following end of each segment 2 is pressed radially against tapered member 1 by means of a leaf spring 4. Leaf spring 4 is fastened at one end to spar 15 of the pipe expander, thereby allowing the other, free end to contact the following end 26 of segment 2. In this manner, leaf spring 4 presses inwardly, maintaining a force opposing any outward motion of the following end 26 of segment 2. It is also understood that other spring techniques can be utilized herein without deviating from the scope of the instant invention. Tapered member 1 is displaced using an ordinary hydraulic displacement device, known in the art, via connecting rod 5 shown in FIG. 1.

Provision of oil or other lubricant to the sliding surfaces, consisting of surface 22 of segment 2 and surface 20 of the pyramidal wall of tapered member 1, is provided by means of bored hole 6 which constitutes a conduit for feeding lubricant to the surfaces. Likewise, bored hole or conduit 13 provides lubrication to the dove-tailed guide 3 which slides along corresponding and adjacent grooves 11, 12 in the pyramidal wall 20 of tapered member 1, as more fully described below.

Figure 2:
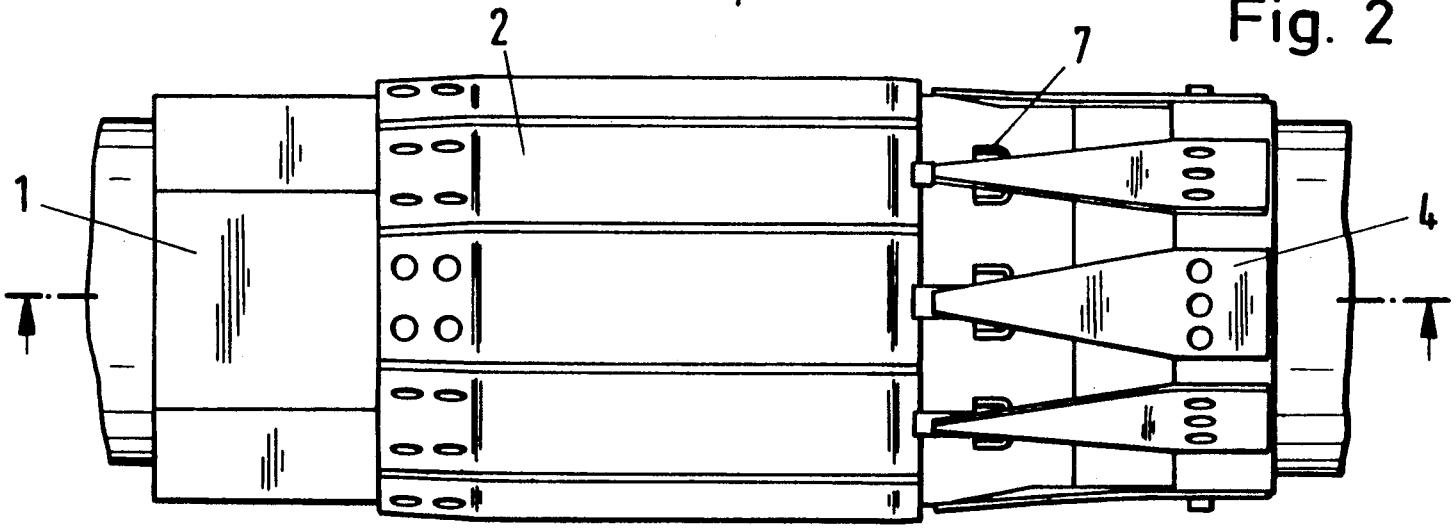
FIG. 2 is an outside, topographical view of the pipe expander.

FIG. 2 shows an outer view of a group of segments 2, surrounding tapered member 1, and a more detailed view of the preferred embodiment for leaf springs 4. As is shown in FIG. 2, leaf springs 4 possess a trapezoidal design, fastened to spar 15, at the larger end of spring 4. T-block guides 7 also connect the forward end of each segment 2 in radially moveable manner to spar 15 of the pipe expander, in a manner known by those skilled in the art.

Figure 3:
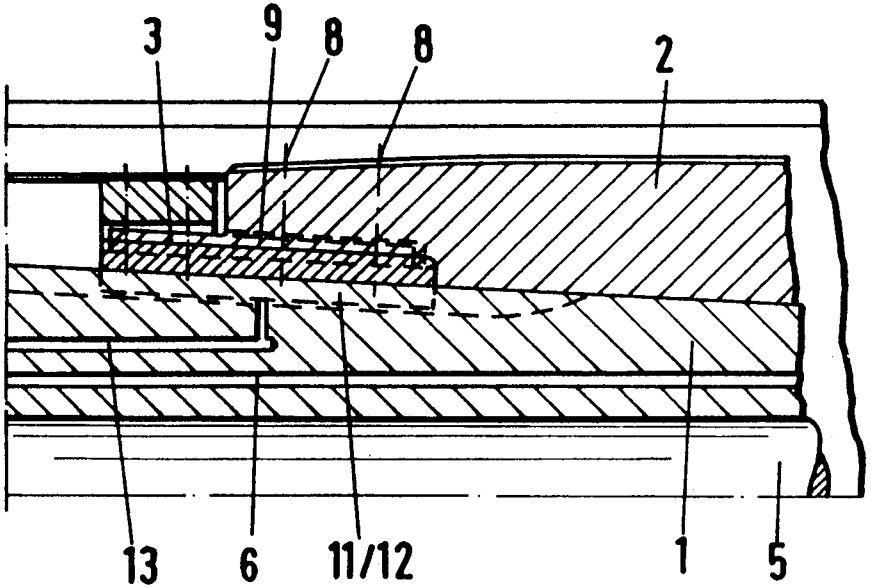
FIG. 3 is an expanded, sectional view along part of the length of the guide elements.

FIG. 3 shows an enlarged view of the radial holding and guidance mechanism for segments 2 by means of guide 3, in accordance with a preferred embodiment of the instant invention. In this embodiment, bronze shoe 3 is fastened by screws 8 to segment 2 in a corresponding recess in the segment. Feather key 9 is positioned to take up the lateral forces in the axial plane of the segment.

Figure 4:
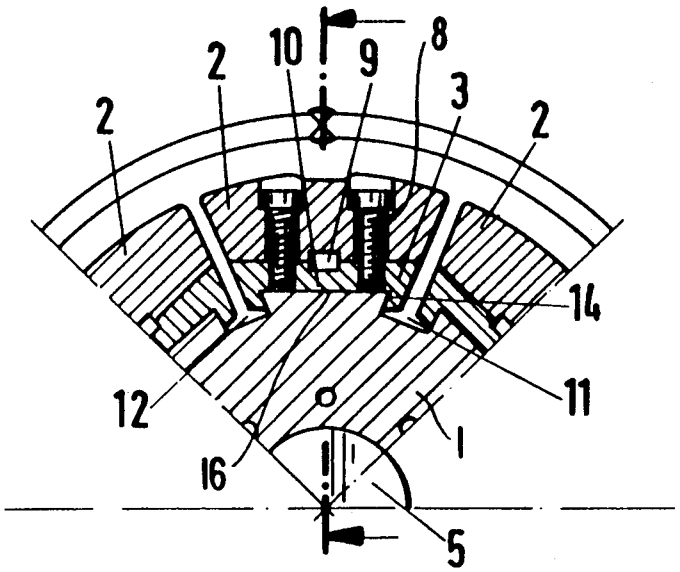
FIG. 4 is a cross-sectional view of the region of the guide elements of a pipe expander shown in the foregoing figures.

As is more clearly shown in FIG. 4, when viewed in connection with FIG. 3, tapered member 1 is shown with a tenon protruding therefrom, surrounded by a dove-tailed mortise contained in bronze shoe 3. There are a number of such tenons defining the sides of the polyhedronal cross-section of tapered member 1, and an equal number of mortises in bronze shoes 3. The tenon shown in FIG. 3 is trapezoidal, possessing slide surface 16 along its top and adjacent slide surfaces 14, separated and formed by adjacent recesses or grooves 11 and 12. Likewise the recessed mortise 10 shown in FIG. 3 in bronze shoe 3 possesses a corresponding slide surface which abuts and slides along slide surfaces 16 and 14. Thus each trapezoidal mortise void 10 in shoe 3 conforms with each tenon in tapered member 1, such that each mortise and tenon when slid together form a dove-tailed connection. Thus, there are the same number of tenons as mortises in the overall configuration, and movement between each tenon and mortise occurs in an axial direction relative to the polyhedronal cross-section of tapered member 1, or, stated another way, perpendicular to the plane of the page showing FIG. 4. The recesses or grooves 11 and 12 define the trapezoidal tenons in tapered member 1 and extend in the longitudinal direction in the region of the edges of each polyhedronal face of tapered member 1.

As shown in FIG. 3, the length of grooves 11 and 12 correspond to the length and path of displacement of tapered member 1 with respect to segments 2. Also, since grooves 11 and 12 do not run the full length of tapered member 1, tapered member 1 is not significantly weakened. As can be seen in FIGS. 1, 3, and 4, grooves 11 and 12 reside in the thicker region of tapered member 1, which further serves to provide a stronger attachment than that heretofore known. The dove-tailed connections formed by the plurality of segments 2 against tapered members, shown by the trapezoidally shaped mortises in bronze shoe 3 and trapezoidally shaped tenons in tapered member 1, comprise strong and tight connections. Screws 8, as shown in FIGS. 3 and 4 provide additional strengthening.

While various configurations have been given herein, it is understood that such is provided merely by way of example, and numerous other arrangements and configurations could be utilized in practice that may vary from those described, but still remain within the scope of the claimed invention.

Accordingly, while there have been shown, described and pointed out the fundamental novel features of the invention as applied to a preferred embodiment thereof, it will be understood that various omissions, substitutions and changes in the form and details of the device illustrated and in its operation may be made by those skilled in the art without departing from the spirit of the invention. It is the intention therefore to be limited only as indicated by the scope of the claims appended hereto.

It is claimed:

1. A mechanical pipe expander, comprising:

a tapered member having an axis, a relatively thicker end, a relatively thinner end, a polyhedronal cross-section formed by axially extending pyramidally shaped walls, and at said relatively thicker end a plurality of axially extending tenons placed between the junctions of each of said walls;

a plurality of segments having a leading and following end and a mortise of predetermined length at said leading end, each mortise and tenon forming a dove-tail engagement in which said engaged mortise and tenon are relatively slideable in said axial direction along a path of displacement; and spring means mounted on said member and placed in contact with said following end of each segment for urging said following end against said member in a radially inward direction.

2. The expander of claim 1, wherein said predetermined length is 5-30% of the length of said segment.

3. The expander of claim 1, wherein said predetermined length corresponds to said path of displacement of said tapered member with respect to said segments.

4. The expander of claim 1, wherein each of said segments comprises a bronze shoe and wherein said mortise is formed in said bronze shoe, and each of said shoes being fastened to a respective one of said segments.

5. The expander of claim 1, wherein said spring means comprises a plurality of trapezoidal leaf springs having a narrow end, each of said narrow ends pressing against a respective one of said following ends of said segment.

6. The expander of claim 1, wherein non-conical grooves having parallel side edges are formed between said axially extending tenons.

* * * * *